US006688367B1

(12) United States Patent
Ruposky et al.

(10) Patent No.: US 6,688,367 B1
(45) Date of Patent: Feb. 10, 2004

(54) EXTENDABLE INTERIOR CEILING FINISHING TOOL

(76) Inventors: George A. Ruposky, 1240 Fifth Ave., Monongahela, PA (US) 15063; Alena M. Ruposky, 1240 Fifth Ave., Monongahela, PA (US) 15063

( * ) Notice: Subject to any disclaimer, the term of this patent is extended or adjusted under 35 U.S.C. 154(b) by 104 days.

(21) Appl. No.: 10/057,384

(22) Filed: Jan. 25, 2002

(51) Int. Cl.[7] ..... E04F 21/165

(52) U.S. Cl. ..... 156/574; 156/579; 15/105; 15/144.3; 15/230.11; 15/236.01; 492/13; 492/19

(58) Field of Search ..... 156/574, 579; 15/144.1, 144.3, 144.4, 117, 105.5, 121, 245, 105, 230.11, 236.01; 492/13, 19

(56) References Cited

U.S. PATENT DOCUMENTS

| | | | | | |
|---|---|---|---|---|---|
| 314,798 | A | * | 3/1885 | Case | 156/577 |
| 702,338 | A | * | 6/1902 | Boord | 15/105 |
| 987,010 | A | * | 3/1911 | O'Brien | 15/117 |
| 1,746,311 | A | * | 2/1930 | King | 156/574 |
| 1,818,917 | A | * | 8/1931 | Wolf | 15/114 |
| 2,185,052 | A | * | 12/1939 | Daugherty | 15/236.01 |
| 2,298,682 | A | * | 10/1942 | Dahlstrom | 15/230.11 |
| 2,741,788 | A | * | 4/1956 | Shey | 401/25 |
| 3,097,384 | A | * | 7/1963 | Clark | 15/111 |
| 3,175,241 | A | * | 3/1965 | Singleton et al. | 15/248.2 |
| 3,463,694 | A | * | 8/1969 | de Roshia | 156/523 |
| D246,569 | S | | 12/1977 | Wesson | |
| 4,381,911 | A | | 5/1983 | Bell | |
| 4,391,013 | A | | 7/1983 | Janssen | |
| 5,186,392 | A | | 2/1993 | Pleshek | |
| 5,539,949 | A | * | 7/1996 | Stanton | 15/121 |
| 5,542,183 | A | | 8/1996 | Allison | |
| 5,632,569 | A | | 5/1997 | Szmansky | |
| 5,741,844 | A | | 4/1998 | Nass et al. | |
| 5,771,525 | A | | 6/1998 | Fulcher et al. | |
| 5,862,562 | A | * | 1/1999 | Erken | 15/117 |
| 5,881,424 | A | * | 3/1999 | Pleener | 15/119.2 |
| 6,385,807 | B1 | * | 5/2002 | Pinochi | 15/119.2 |

* cited by examiner

*Primary Examiner*—Mark A. Osele
(74) *Attorney, Agent, or Firm*—John D. Gugliotta

(57) ABSTRACT

An apparatus is provide that aids in the finishing of ceilings. The tool provides for the rolling on of cement or other similar finishes and then an integral knife blade smoothes over the finished surface. Such an invention prevents the user from using multiple tools, and from using stilts to reach the ceiling surface.

3 Claims, 4 Drawing Sheets

EXTENDABLE INTERIOR CEILING FINISHING TOOL

RELATED APPLICATIONS

The present invention was first described in Disclosure Document Registration 457,366 filed on Jun. 7, 1999 under 35 U.S.C. §122 and 37 C.F.R. §1.14. There are no previously filed, nor currently any co-pending applications, anywhere in the world.

BACKGROUND OF THE INVENTION

1. Field of the Invention

The present invention relates generally to drywall finishing tools and, more particularly, to a ceiling finishing tool consisting of an elongated handle with a paint roller attachment at the end and a joint compound/cement finishing tool on the end of an extension slidably attached to the handle so that the joint compound/cement finishing tool can be selectively lowered or raised to allow the user to use the paint roller attachment.

2. Description of the Related Art

Ask anyone who has spent time working on or finishing ceilings the worst part of the job and they will usually say that working over their head is the worst part. The stress put on one's body by lifting their arms high and craning their neck back, produces body aches and pains that last long after the job is done. Additionally, time spent climbing up and down ladders not only adds to these aches and pains but adds to the time it takes to complete the job. One may work on stilts to accomplish the job as well, but these require time to become accustomed to and are not practical for amateurs or do-it-yourself projects. Finally, the use of multiple tools requires readjustment, different angles of application and other inconsistencies which affect the overall finish thus producing an inferior looking product, not to mention increased cleanup time for the multiple tools.

A search of the prior art did not disclose any patents that read directly on the claims of the instant invention; however, the following references were considered related.

U.S. Pat. No. Des. 246,569 issued in the name of Wesson disclose the design and function of a cement finishing tool.

U.S. Pat. No. 5,771,525 issued in the name of Fuicher describes a drywall and stucco application device including an extension pole.

U.S. Pat. No. 5,741,844 issued in the name of Nass et al. discloses a coating composition and method for finishing a plaster wall or ceiling.

U.S. Pat. No. 5,632,569 issued in the name of Szmansky describes a cement finishing hand tool with a vibrating blade.

U.S. Pat. No. 5,542,183 issued in the name of Allison discloses a firefighter's ceiling cutting tool with a telescoping tubular section.

U.S. Pat. No. 5,186,392 issued in the name of Pleshek describes an extendable elongate liquid-applying device for cleaning interior walls or ceilings.

U.S. Pat. No. 4,391,013 issued in the name of Janssen discloses a finishing tool for smoothing wallboard tape joints of interior walls and ceilings.

U.S. Pat. No. 4,381,911 issued in the name of Bell describes a portable, hand-controlled cement finishing machine comprising an elongated shaft.

Consequently, there is a need for a means by which cement or other ceiling finishing compounds can be applied in a quick and effortless manner, using a minimum of tools, which produces a quality, professional looking finished product.

SUMMARY OF THE INVENTION

It is therefore an object of the present invention to provide an improved drywall finishing tool.

It is a feature of the present invention to provide an improved drywall finishing tool that combines the functionality of a roller with the functionality of a drywall finishing blade.

Briefly described according to one embodiment of the present invention, an apparatus that aids in the finishing of ceilings is provided. The tool provides for the rolling on of cement or other similar finishes and then an integral knife blade smooths over the finished surface. Such an invention prevents the user from using multiple tools, and from using stilts to reach the ceiling surface. There is also a notable decrease in application time, since multiple tools do not have to be used. Finally, since multiple tools are not used, there is more consistent application of the finishing compound with respects to application angle, application force and application quantity that results in a higher quality finished job.

The use of present invention allows for the finishing of ceilings in a quick and easy manner without the use of multiple tools that results in a higher quality finish.

An advantage of a multi-headed ceiling finishing tool allows for provides higher quality finish on ceilings with reduces application time by eliminates the use of multiple tools.

Further, an extension handle allows user to reach ceiling without the use of stilts.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
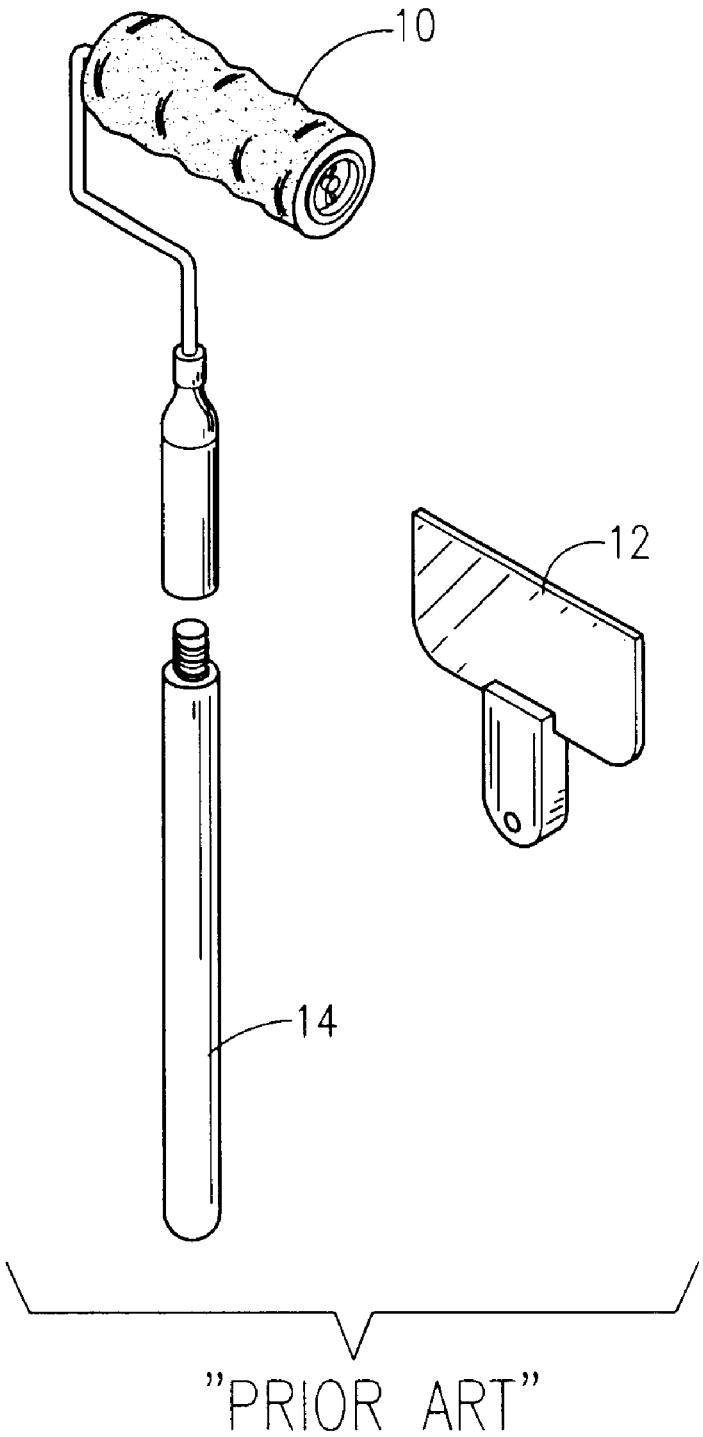
FIG. 1 is an partial exploded plan view of the PRIOR ART.

In order to describe the complete relationship of the invention, it is essential that some description be given to the manner and practice of functional utility and description of conventionally available tools, as shown in FIG. 1, which represent the PRIOR ART in which a separate tools provide for the rolling on of cement or other similar finishes (see the roller 10) and then a separate knife blade 12 smooths over the finished surface. In order to obtain sufficient linear extension, the user uses stilts to reach the ceiling surface or an extension stick 14 that threadingly engages with the roller 10.

Figure 2:
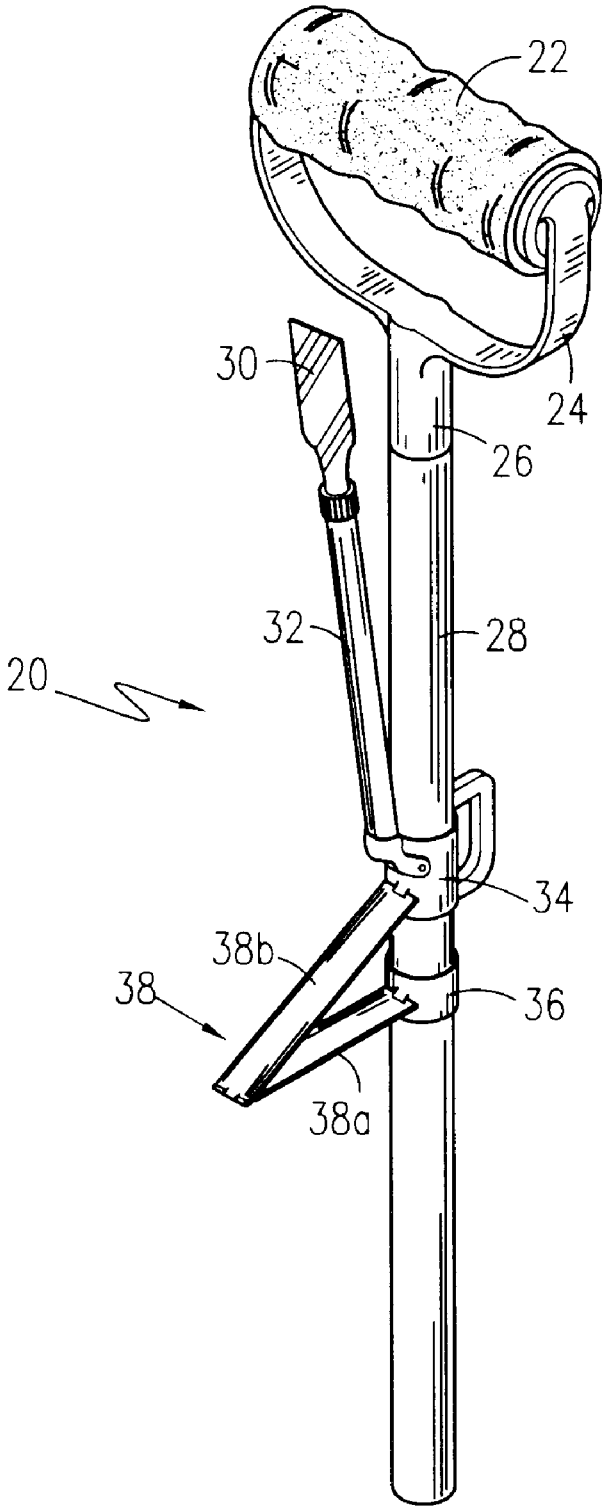
FIG. 2 is a perspective view of interior wall and ceiling finishing tool according to the preferred embodiment of the present invention.
Figure 3A:
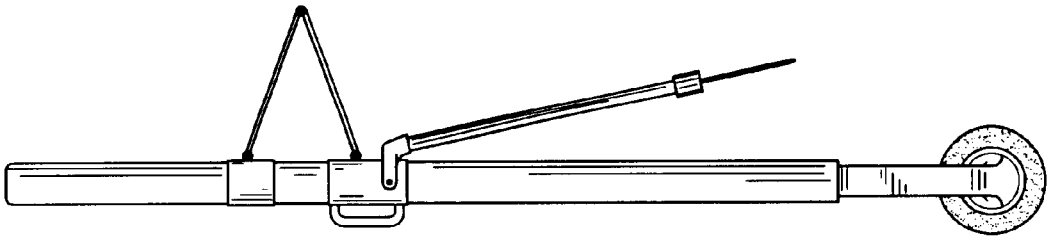
FIG. 3*a* is a side elevational view thereof shown in a retracted condition.
Figure 3B:
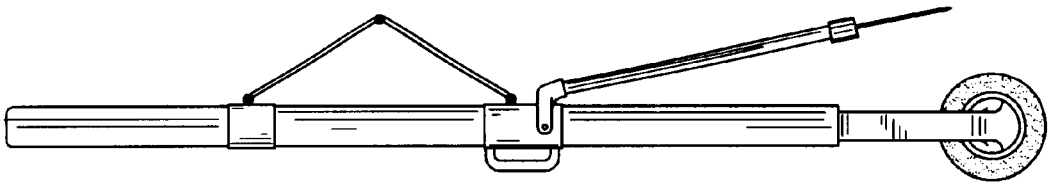
FIG. 3*b* is a side elevational view thereof shown in an extended condition.
Figure 4:
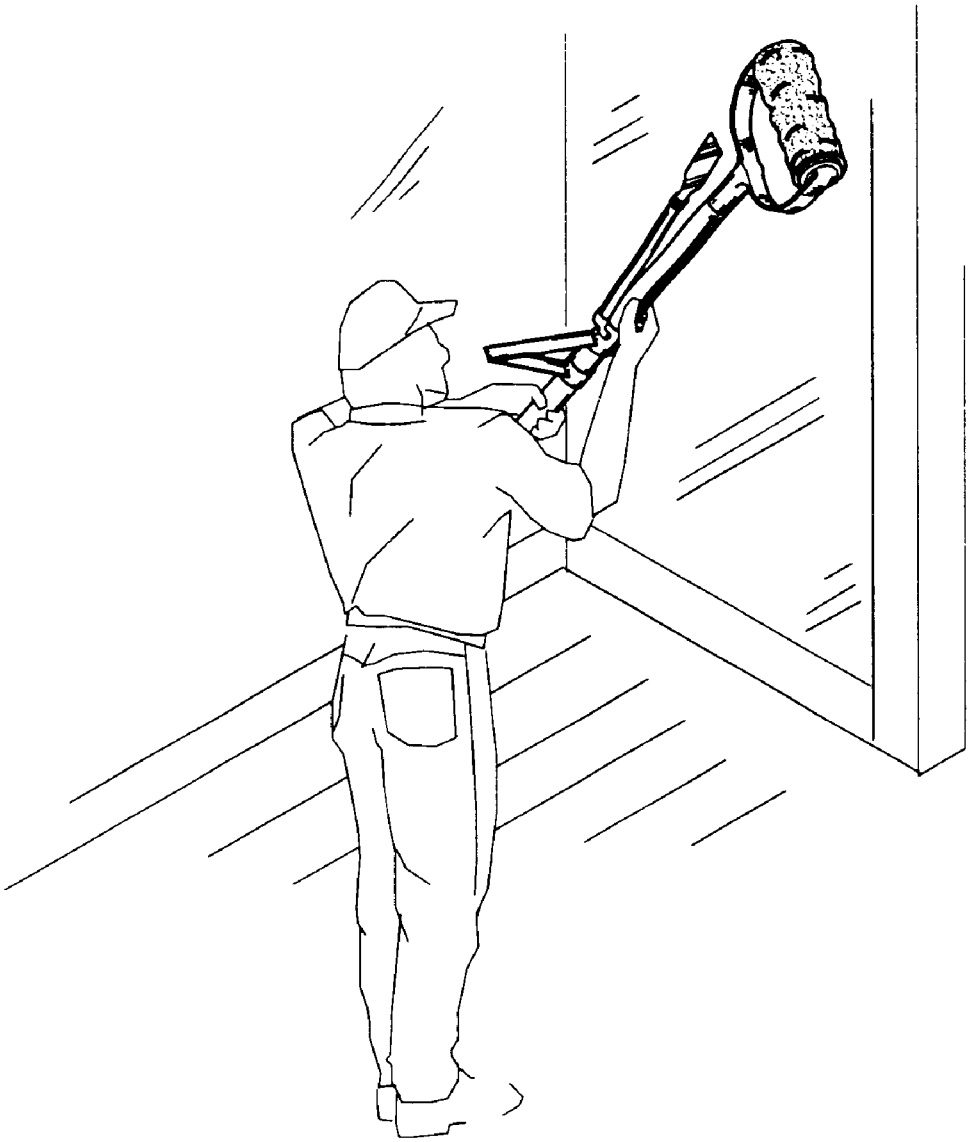
FIG. 4 is a perspective view showing the present invention in use.

The best mode for carrying out the invention is presented in terms of its preferred embodiment, herein depicted within the FIGS. 2–4.

1. Detailed Description of the Figures

Referring now to FIG. 2, a drywall finishing tool 20 is shown, according to the present invention, having a roller 22 rotatably supported on a roller carriage 24 and affixed to a roller handle 26. A linearly elongated shaft extension 28 is affixed to the roller handle 26 such as to allow the roller carriage 24 to be attached and removed as desired. Additionally, a finishing blade 30 is removably affixed to a linearly extended blade extension 32 which is angularly mounted on a slidably retained tracking guide 34. Mounted at an acute angle, the blade extension 32 can be tracked past the roller 22 when the tracking guide 34 is slid along the shaft extension 28. A stationary tracking guide 36 is rigidly affixed to the shaft extension 28 at a level below the slidably retained tracking guide 34.

As shown in FIG. 3*a*–3*b*, an articulating handle 38 connects the stationary tracking guide 36 to the slidably retained tracking guide 34. Formed of a lower handle element 38*a* pivotally affixed to an upper handle element 38*b*, the handle 38 is pivotally affixed at one end to the guide 36 and at the other end to the guide 34 such as to provide a means for extending the blade extension 32 up or down along the shaft 28. In this fashion, the blade 30 can be lowered out of the way when the roller 22 is in use, or raised into position when the roller 22 is not needed.

2. Operation of the Preferred Embodiment

In accordance with a preferred embodiment of the present invention, as shown in FIG. 4, the tool 20 provides for the rolling on of cement or other similar finishes and then an integral knife blade 30 smooths over the finished surface. This prevents the user from using multiple tools, and from using stilts to reach the ceiling surface. The use of present invention allows for the finishing of ceilings in a quick and easy manner without the use of multiple tools that results in a higher quality finish.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. A drywall finishing tool comprising:

a roller rotatably supported on a roller carriage and affixed to a roller handle;

a linearly elongated shaft extension affixed to said roller handle such as to allow the roller carriage to be attached and removed as desired;

a finishing blade;

a stationary tracking guide, wherein said stationary tracking guide is rigidly affixed to said shaft extension at a level below a slidably retained tracking guide; and a linearly extended blade extension angularly mounted on a slidably retained tracking guide to said elongated shaft extension for supporting said finishing blade, wherein said linearly extended blade extension is mounted at an acute angle such as to allow said blade extension to be tracked past said roller when said tracking guide is slid along said shaft extension.

2. The drywall finishing tool of claim 1, further comprising:

an articulating handle for connecting said stationary tracking guide to said slidably retained tracking guide.

3. The drywall finishing tool of claim 2, wherein said articulating handle is formed of a lower handle element pivotally affixed to an upper handle element such that said handle is pivotally affixed such as to provide a means for extending the blade extension up or down along the shaft.

* * * * *